US012703409B2

(12) United States Patent
Alarcon et al.

(10) Patent No.: US 12,703,409 B2
(45) Date of Patent: Aug. 11, 2026

(54) LOADING TURNTABLE SYSTEMS AND METHODS

(71) Applicant: Universal City Studios LLC, Universal City, CA (US)

(72) Inventors: Luis Carlos Alarcon, Orlando, FL (US); Steven C. Blum, Orlando, FL (US); Michael David Russell, Jr., Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 108 days.

(21) Appl. No.: 18/784,414

(22) Filed: Jul. 25, 2024

(65) Prior Publication Data

US 2024/0375692 A1 Nov. 14, 2024

Related U.S. Application Data

(63) Continuation of application No. 18/101,446, filed on Jan. 25, 2023, now Pat. No. 12,060,092, which is a (Continued)

(51) Int. Cl.
*B61K 1/00* (2006.01)
*A63G 1/00* (2006.01)

(Continued)

(52) U.S. Cl.
CPC ..... *B61K 1/00* (2013.01); *A63G 7/00* (2013.01); *B61B 13/00* (2013.01)

(58) Field of Classification Search
CPC .. B61K 1/00; B61B 13/00; A63G 1/00; A63G 4/00

(Continued)

(56) References Cited

U.S. PATENT DOCUMENTS 3,404,635 A 10/1968 Bacon et al.
3,865,041 A 2/1975 Bacon (Continued)

FOREIGN PATENT DOCUMENTS

CN 101314357 A 12/2008
CN 107670286 A 2/2018

(Continued)

OTHER PUBLICATIONS

JP Office Action for Japanese Application No. 2024-152161 mailed Dec. 9, 2025.

(Continued)

*Primary Examiner* — Douglas A Hess
(74) *Attorney, Agent, or Firm* — Fletcher Yoder P.C.

(57) ABSTRACT

An attraction loading system is provided that includes a turntable configured to rotate about a vertical axis. A ride vehicle is configured to travel along a loading path disposed about a perimeter of the turntable. A first track switch of the system is disposed along the loading path to direct the ride vehicle to a main portion of the loading path from an attraction path, or to direct the ride vehicle to the main portion of the loading path from a secondary portion of the loading path. A second track switch of the system is disposed along the loading path to direct the ride vehicle from the main portion of the loading path to the attraction path, or to direct the ride vehicle from the main portion of the loading path to the secondary portion of the loading path.

22 Claims, 4 Drawing Sheets

Related U.S. Application Data continuation of application No. 16/741,400, filed on Jan. 13, 2020, now Pat. No. 11,584,406.

(60) Provisional application No. 62/809,323, filed on Feb. 22, 2019.

(51) Int. Cl.
*A63G 4/00* (2006.01)
*A63G 7/00* (2006.01)
*B61B 13/00* (2006.01)

(58) Field of Classification Search
USPC ..... 104/20, 21, 31, 40
See application file for complete search history.

(56) References Cited

U.S. PATENT DOCUMENTS

| | | | | |
|---|---|---|---|---|
| 4,362,456 | A | 12/1982 | Barry | |
| 4,543,886 | A | 10/1985 | Spieldiener et al. | |
| 4,920,890 | A | 5/1990 | Barber | |
| 5,197,923 | A | 3/1993 | Barber | |
| 5,583,844 | A | 12/1996 | Wolf et al. | |
| 7,758,435 | B2 | 7/2010 | Henry et al. | |
| 7,784,405 | B2 | 8/2010 | Rose et al. | |
| 8,051,777 | B2 | 11/2011 | Weissbrodt | |
| 8,517,847 | B2 | 8/2013 | Crawford et al. | |
| 8,960,097 | B2 | 2/2015 | Fritsche | |
| 9,365,364 | B1 | 6/2016 | Morgan | |
| 10,835,832 | B2 | 11/2020 | Fontiveros Penso et al. | |
| 10,835,833 | B2 | 11/2020 | Grogan et al. | |
| 11,524,710 | B2 | 12/2022 | Towns, Jr. | |
| 11,584,406 | B2 | 2/2023 | Alarcon et al. | |
| 11,613,278 | B2 | 3/2023 | Bertoncello et al. | |
| 11,779,850 | B2 | 10/2023 | Boyle | |
| 12,539,889 | B2 * | 2/2026 | Majdali | A63G 7/00 |
| 2002/0007758 | A1 | 1/2002 | Albrich | |
| 2007/0074638 | A1 | 4/2007 | Blum et al. | |
| 2010/0078291 | A1 | 4/2010 | Fritsche | |
| 2013/0059670 | A1 | 3/2013 | Crawford et al. | |
| 2013/0145953 | A1 | 6/2013 | Crawford et al. | |
| 2015/0012157 | A1 | 1/2015 | Nemeth et al. | |
| 2018/0120862 | A1 | 5/2018 | Dembinski et al. | |
| 2020/0307658 | A1 | 10/2020 | Towns, Jr. | |
| 2021/0062567 | A1 | 3/2021 | Majdali et al. | |
| 2022/0266875 | A1 | 8/2022 | Laffin | |

FOREIGN PATENT DOCUMENTS

| | | | |
|---|---|---|---|
| CN | 107708826 | A | 2/2018 |
| CN | 107715457 | A | 2/2018 |
| JP | H07108090 | A | 4/1995 |
| JP | 2002035436 | A | 2/2002 |
| JP | 2016501571 | A | 1/2016 |
| JP | 2020533068 | A | 11/2020 |
| KR | 20100034178 | A | 4/2010 |
| KR | 101062917 | B1 | 9/2011 |
| WO | 2007050545 | A2 | 5/2007 |

OTHER PUBLICATIONS

SG Office Action for Singapore Application No. 11202108134S mailed Jan. 2, 2023.
PCT/US2020/018540 Invitation to Pay Additional Fees May 25, 2020.
IN Office Action for India Application No. 202117040774 mailed Jul. 27, 2023.
JP Office Action for Japanese Application No. 2021-549400 mailed Nov. 1, 2023.
CN Office Action for Chinese Application No. 202080015712.4 mailed Jan. 22, 2024.
EP Extended European Search Report for European Application No. 26171008.1 mailed Jun. 22, 2026.

* cited by examiner

LOADING TURNTABLE SYSTEMS AND METHODS

CROSS-REFERENCE TO RELATED APPLICATIONS

This application is a continuation of U.S. patent application Ser. No. 18/101,446, filed Jan. 25, 2023, which claims priority to U.S. patent application Ser. No. 16/741,400, entitled "LOADING TURNTABLE SYSTEMS AND METHODS," filed Jan. 13, 2020, which claims priority to U.S. Provisional Application No. 62/809,323, entitled "LOADING TURNTABLE SYSTEMS AND METHODS," filed Feb. 22, 2019. All of these applications are incorporated herein by reference in its entirety for all purposes.

BACKGROUND

The present disclosure relates generally to the field of amusement parks. More particularly, embodiments of the present disclosure relate to systems and methods for implementing flexible passenger loading and unloading time in an attraction of an amusement park.

Recently, there has been a growing interest in increasing an efficiency of loading passengers into ride vehicles of attractions of amusement parks. For example, some attractions may include loading systems that have ride vehicles continuously moving along a loading zone as passengers unload from a ride vehicle and/or as new passengers load into the ride vehicle. However, some passengers may take a long time to leave the ride vehicle and/or may take a long time to board the ride vehicle. That is, a loading passenger may not be fully boarded and secured within the ride vehicle before the ride vehicle reaches an end of the loading zone. In such instances, movement of all of the ride vehicles through the attraction and/or the loading zone may be affected to give the loading passenger extra time to board the ride vehicle. For example, in one scenario, each ride vehicle may come to a complete stop in order to allow the loading passenger extra time in the loading zone to board the ride vehicle. Slowing or stopping of the ride vehicles' movement through the attraction may be detrimental to a throughput of the attraction, which can lead to increased waiting times and decreased revenue for the amusement park.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, an attraction loading system is provided that includes a turntable configured to rotate about a vertical axis and a ride vehicle configured to travel along a loading path disposed about a perimeter of the turntable. The system also includes a first track switch disposed along the loading path configured to be disposed in a first position to direct the ride vehicle to a main portion of the loading path from an attraction path, and configured to be disposed in a second position to direct the ride vehicle to the main portion of the loading path from a secondary portion of the loading path and a second track switch disposed along the loading path configured to be disposed in a third position to direct the ride vehicle from the main portion of the loading path to the attraction path, and configured to be disposed in a fourth position to direct the ride vehicle from the main portion of the loading path to the secondary portion of the loading path.

In an embodiment, a method is provided that includes the steps of directing a ride vehicle along a loading path at a first location of the loading path toward a second location of the loading path; determining an occupancy status of the ride vehicle; and based on the occupancy status of the ride vehicle, controlling a track switch to direct the vehicle along either the loading path or along an attraction path at the second location along the loading path.

In an embodiment, an attraction loading system is provided that includes a turntable configured to rotate about a vertical axis. The system also includes a loading path disposed about a perimeter of the turntable, wherein a ride vehicle is configured to move along the loading path. The system also includes a first track switch disposed along the loading path, wherein the first track switch is configured to direct the ride vehicle from to a main portion of the loading path from either a secondary portion of the loading path or an attraction path and a second track switch disposed along the loading path, wherein the second track switch is configured to direct the ride vehicle from the main portion of the loading path to either the secondary portion of the loading path or an attraction path.

In an embodiment, an attraction loading system is provided that includes a loading and/or unloading area comprising a conveyor. The system also includes a loading path disposed about a perimeter of the conveyor, wherein a ride vehicle is configured to move along the loading path and an attraction path coupled to the loading path. The system also includes a controller configured to direct the ride vehicle from the loading path onto the attraction path based on a first occupancy status of the vehicle or to direct the ride vehicle to re-loop the loading path based on a second occupancy status of the ride vehicle.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
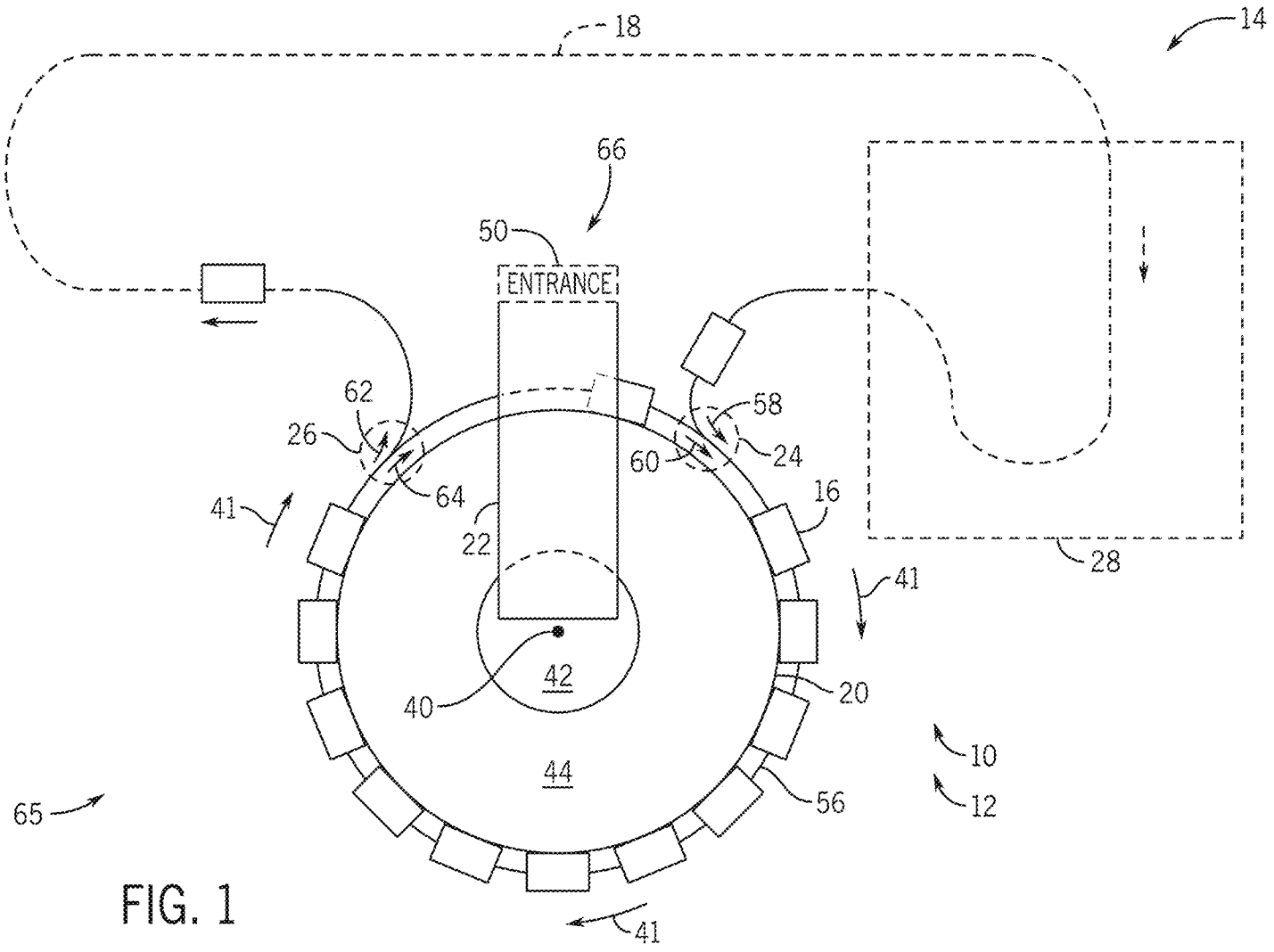
FIG. 1 is a schematic plan view of an embodiment of the loading system.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The disclosed embodiments generally relate to a loading system configured to provide for a variable amount of available loading time of passengers into ride vehicles. More specifically, the disclosed embodiments provide for variable passenger loading time into a particular ride vehicle while allowing other ride vehicles to continue at nominal speeds through a loading zone and through the attraction. For example, the disclosed loading system may include a loading zone having a turntable configured to continuously rotate about a central vertical axis. The loading zone is configured to receive occupied ride vehicles (e.g., passenger-occupied vehicles) at a first radial position (e.g., relative to the central vertical axis) along a perimeter of the turntable. In some embodiments, the first radial position may include a first track switch. The ride vehicles and the turntable are configured to rotate in conjunction from the first radial position to a second radial position (e.g., relative to the central vertical axis along the perimeter of the turntable. In some embodiments, the first radial position may include a first track switch. The rotational speed of the ride vehicles may substantially match the rotational speed of the turntable such that relative movement between the ride vehicles and the turntable may be substantially unperceivable. In other words, an edge of the turntable may be stationary relative to an edge of the ride vehicle to create a static physical interface, or virtual coupling, between the ride vehicles and the turntable.

Passengers may unload from the ride vehicles onto the turntable. Once passengers are unloaded from the ride vehicles, new passengers may be directed to load onto the ride vehicles from the turntable. Generally, in order to increase a throughput of users through the attraction, the turntable and the ride vehicles may be continuously rotating at a nominal speed as the passengers are unloading and loading the ride vehicles. The ride vehicles may continue to move in conjunction with the turntable until the ride vehicles reach the second radial position. If a ride vehicle is occupied with a loaded passenger by the time the ride vehicle reaches the second radial position, the ride vehicle may be directed along an attraction path to begin a ride cycle of the attraction. However, if the ride vehicle is unoccupied and a passenger is still attempting to load the ride vehicle by the time the ride vehicle reaches the second radial position, the ride vehicle may be directed to continue rotating (e.g., re-loop through the loading pathway) with the turntable back through to the first radial position. The passenger may continue to attempt to board the ride vehicle as the ride vehicle travel is re-looped from the second radial position to the first radial position, and once again from the first radial position to the second radial position. Once the passenger has successfully loaded into the ride vehicle, and the ride vehicle reaches the second radial position, the ride vehicle may be directed along the attraction path. In this manner, slower-loading passengers may not cause a disruption to other passengers, as each ride vehicle continues to move at a nominal speed through the loading zone regardless of the occupancy status of the other ride vehicles. Thus, passengers may have an increased amount of available time to load the ride vehicles.

Turning now to the figures, FIG. 1 is a schematic plan view of an embodiment of a loading zone 10 of a loading system 12. As shown, the loading zone 10 may be a portion of an overall ride system 14 (e.g., an attraction). For example, passengers may load into ride vehicles 16 in the loading zone 10, may travel along an attraction path 18 of the ride system 14, and may arrive back at the loading zone 10 to unload from the ride vehicles 16. While traveling along the attraction path 18, passengers may be exposed to a variety of experiences, such as virtual reality, alternate reality, environment interactions, multiple ride paths, water features, special effects, and so forth. It should be noted that portions of the ride system 14, such as the attraction path 18, have been intentionally simplified to focus on aspects of the loading system 12.

The loading system 12 includes a turntable 20, an entrance ramp 22, a first track switch 24, a second track switch 26, and a variable speed zone 28. The turntable 20 is configured to rotate at a substantially constant rotational speed about an axis 40. In the currently illustrated embodiment, the turntable 20 is substantially circular and rotates in a clockwise direction 41. However, the turntable 20 may be any suitable shape, which may correspond to a theme of the ride system 14, and may rotate in the counter-clockwise direction. In some embodiments, the turntable 20 may include a stationary portion 42 disposed within a rotational portion 44. That is, the rotational portion 44 may be configured to rotate about the stationary portion 42 while the stationary portion 42 remains stationary.

The entrance ramp 22 may be any suitable angled path, which may include stairs, a substantially flat angled surface, an escalator, or any combination thereof. Generally, users may enter the loading zone 10 from an entrance 50, descend the entrance ramp 22 toward a middle portion (e.g., the stationary portion 42) of the turntable 20, and load into the ride vehicle 16. Similarly, users may ascend the entrance ramp 22 toward the entrance 50 to leave the loading zone 10.

The ride vehicles 16 may enter the loading zone 10 through the variable speed zone 28, which is located at an end of the attraction path 18. As discussed in further detail below, speeds of the ride vehicles 16 may be augmented and/or may vary as the ride vehicles 16 travel through the variable speed zone 28. For example, in some embodiments, speeds of the ride vehicles 16 may be adjusted to create a gap (e.g., a bubble) between the ride vehicles 16 or to remove a gap between the ride vehicles 16. Indeed, each ride vehicle 16 may be independently controlled such that each ride vehicle 16 may travel at different speeds for at least a portion of the travel time.

From the variable speed zone 28, the ride vehicles 16 may enter a loading path 56, which is disposed about a perimeter of the turntable 20. The first track switch 24, in one configuration, permits the ride vehicles 16 from the attraction path 18 to slot into available spaces in the loading path 56 and, alternatively or additionally, changes position to allow ride vehicles 16 that have been re-looped along the loading path 16 to continue along the loading path 16 through the first track switch 24 in another configuration.

While the ride vehicle 16 is moving along the loading path 56, passengers may load and unload the ride vehicles 16. The loading path 56 may include a track or a conveyor, or may be a virtual path for a trackless ride system along which the ride vehicles 16 travel. In some embodiments, the loading path 56 is a path along which the ride vehicles 16 travel while rotating in conjunction with (i.e., together with or at the same speed as) the turntable 20. As shown, while traveling along the loading path 56, the ride vehicles 16 may rotate at substantially the same rotational speed as the turntable 20. In this manner, a position and orientation of each ride vehicle 16 of the plurality of ride vehicles along the perimeter of the turntable 20 may remain substantially constant. In other words, each ride vehicle 16 may maintain a temporarily fixed position relative to a circumference of the turntable 20 while traveling through the loading path 56 and while the turntable 20 rotates about its center point such that the orientation of the turntable 20 relative to the ride vehicles 16 (e.g., with seats facing towards a center or alongside an edge of the turntable 20) is substantially maintained. For example, in the currently illustrated embodiment having a substantially circular turntable 20, each ride vehicle 16 of the plurality of ride vehicles may continuously face the axis 40 of the turntable 20 as the ride vehicles 16 travel along the loading path 56. In certain embodiments, the rotational speed of the turntable 20 as well as the speed of the vehicles in the loading path 56 is less than an average speed of the ride vehicles 16 in the attraction path 18.

From the variable speed zone 28, the ride vehicles 16 may traverse the first track switch 24 to enter the loading path 56. Indeed, as discussed in further detail below, the first track switch 24 may be in a first position, such as to direct the ride vehicles 16 along a first direction 58 (e.g., a counter-clockwise direction) from the variable speed zone 28 to the loading path 56. Alternatively, the first track switch 24 may be in a second position, such as to direct the ride vehicles 16 along a second direction 60 (e.g., a clockwise direction) from other portions of the loading path 56 to continue along the loading path 56. Similarly, the second track switch 26 may be in a third position, such as to direct the ride vehicles 16 along a third direction 62 (e.g., a counter-clockwise direction) from the loading path 56 toward a start of the attraction path 18. Alternatively, the second track switch 26 may be in a fourth position, such as to direct the ride vehicles 16 along a fourth direction 64 (e.g., a clockwise direction) to travel further along the loading path 56 toward the first track switch 24.

In the depicted embodiment, the ride vehicles 16 are configured to enter the loading zone 10, and travel along the loading path 56 from the first track switch 24 clockwise 41 toward the second track switch 26 (e.g., a main portion 65 of the loading path 56). As a first ride vehicle 16 travels along the loading path 56, passengers may unload from the first ride vehicle 16. Once the passengers are unloaded from the first ride vehicle 16, new passengers may be directed to load into the first ride vehicle 16. The new passengers may attempt to load the first ride vehicle 16 as the first ride vehicle 16 travels along the main portion 65. If the new passengers have successfully loaded into the first ride vehicle 16 before the first ride vehicle 16 reaches the second track switch 26, the first ride vehicle 16 may be directed, via the second track switch 26, from the loading path 56 to the attraction path 18. However, if the new passengers have not successfully loaded into the first ride vehicle 16 before the first ride vehicle 16 reaches the second track switch 26, the first ride vehicle 16 may be directed, via the second track switch 26, to continue along the loading path 56 toward the first track switch 24 (e.g., along a secondary portion 66 of the loading path 56). Indeed, as shown, the secondary portion 66 of the loading path 56 may be disposed beneath the entrance ramp 22. That is, the passengers and the first ride vehicle 16 may travel beneath the entrance ramp 22 while the passengers continue to attempt to load into the first ride vehicle 16. Accordingly, the ramp 22 is arranged such that the clearance underneath the ramp 22 is sufficient to permit clearance of the ride vehicles 16 and any unloaded passengers traveling underneath the entrance ramp 22 from the position of the second track switch 26 to the first track switch 24.

The first ride vehicle 16 may continue to move along the loading path 56 in this manner until the new passengers have loaded into the first ride vehicle 16. Once the passengers have loaded into the first ride vehicle 16, and the first ride vehicle 16 reaches the second track switch 26, the first ride vehicle 16 may be directed from the loading path to the attraction path 18. Thus, the passengers may have increased time to load into the first ride vehicle 16.

Figure 2:
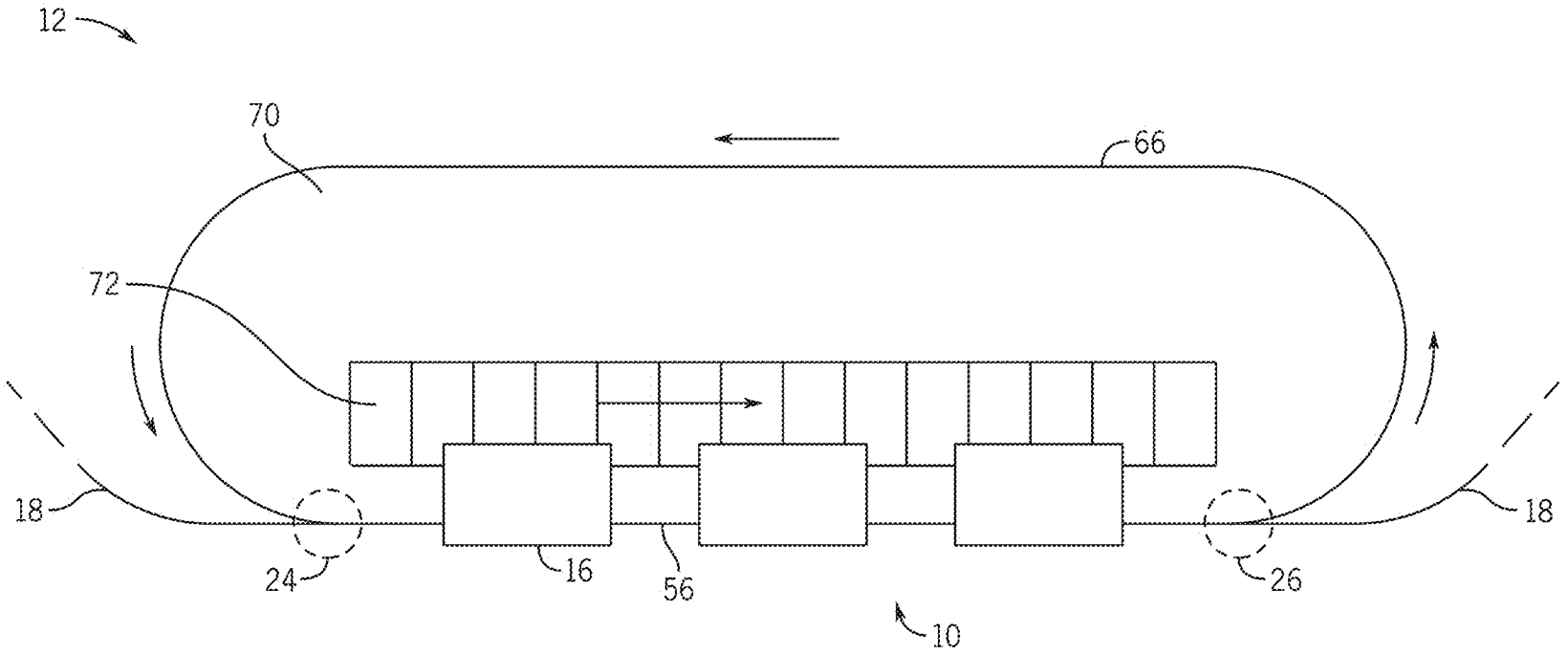
FIG. 2 is a schematic plan view of an embodiment of the loading system.

While FIG. 1 is discussed in reference to a track-based loading system 12 that uses a turntable 20, it should be understood that other loading/unloading arrangements may also be used in conjunction with the present techniques. For example, a trackless loading system 12 may use trackless vehicles 16 that travel along a pre-programmed or variable path. In certain embodiments, as illustrated in FIG. 2, the system 12 may include a loading station 70 with a conveyer 72 that may be shaped to accommodate irregular loading areas (e.g., peninsula, elongated, or other shapes) and that moves relative to a programmed loading path 56 along which track-based or trackless vehicles 16 travel. The loading path 56 aligns with a direction of the conveyor 72 such that the passengers may load into the ride vehicles 16 while positioned on the conveyor 72. The ride vehicles 16 may travel along the loading path 16 at a speed approximately equal to a speed of the conveyor 72. To accommodate passengers that may need additional time for loading, the vehicles may be directed via the second track switch 26 onto the secondary portion 66 of the loading path 56 to be re-looped for passenger loading.

Movement back onto the attraction path 18 and/or re-looping back into the loading path 56 may be controlled by a controller (see FIG. 4) of the loading system sending control signals to vehicle controllers of individual ride vehicles 16 based on occupancy status as provided herein. Based on the received control signals, the individual ride vehicles enter the attraction path 18 or re-loop onto the loading path 56 according to the instructions of the control signal.

Figure 3:
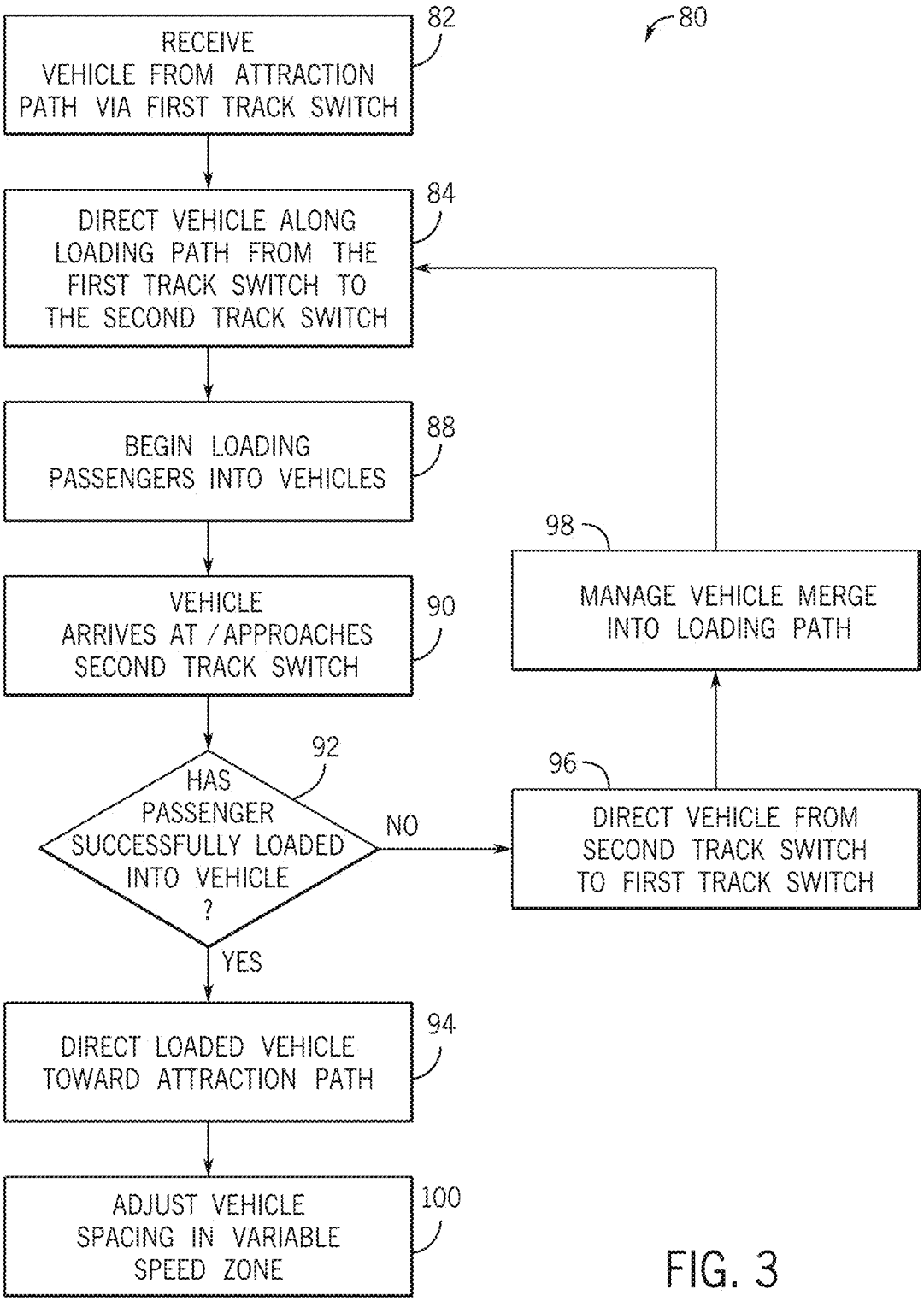
FIG. 3 is a flow diagram of a method of operating the loading system.

Keeping this in mind, FIG. 3 is a flow chart of an embodiment of a loading process 80 that may be utilized by the loading system 12. Accordingly, the following discussion may reference FIGS. 1-2 in parallel with FIG. 3. Further, the following discussion references the progress of a particular ride vehicle 16 through the loading process 80.

At block 82, the first ride vehicle 16 may enter the loading zone 10 from the attraction path 18. More specifically, after traveling along the attraction path 18, the ride vehicle 16 may travel through the variable speed zone 28 and traverse the first track switch 24.

At block 84, the first ride vehicle 16 may be directed along the main portion 65 of the loading path 56 via the first track switch 24. Particularly, the first track switch 24 may be in the first position by default to direct the first ride vehicle 16 in the first direction 58 from the variable speed zone 28. After passing the first track switch 24 into the loading path 56, passengers present on the ride vehicle who have completed the attraction via travelling the attraction path 18 may unload from the first ride vehicle 16 while the first ride vehicle 16 continues to move along the main portion 65 of the loading path 56. However, it should be understood that passengers on the ride vehicles 16 may alternatively represent passengers in the loading stage who have not yet entered the attraction path 18 and who are in an incompletely loaded ride vehicle 16. At block 88, ride operators may direct new passenger(s) to load into the first ride vehicle 16 while the first ride vehicle 16 continues to move along the main portion 65 of the loading path 56.

The first ride vehicle 16 may continue along the loading path 56 from the first track switch 24 to the second track switch 26 while the passengers continue to load into the first ride vehicle 16. At block 90, the first ride vehicle 16 may arrive at the second track switch 26. More specifically, at block 90, the first ride vehicle may approach the second track switch 26. At block 92, as the first ride vehicle 16 approaches the second track switch 26, a controller and/or operator will determine whether the passengers have successfully loaded into the first ride vehicle 16. For example, in some embodiments, as the first ride vehicle 16 travels along the main portion 65 of the loading path 56 (e.g., during blocks 84, 86, 88, and 90), an operator may observe the passenger unloading and loading the first ride vehicle 16. Once the passengers have successfully loaded into the first ride vehicle 16, the operator may provide a load confirmation signal to the loading system 12 to confirm an occupancy status of the first ride vehicle 16 (e.g., fully loaded, empty, or partially loaded). In certain embodiments, re-looping may be rules-based, such that fully-loaded vehicles are always moved onto the attraction path, empty vehicles are always re-looped, and partially loaded ride vehicles are either re-looped based on a signal indicative of passengers still attempting to load or moved onto the attraction based on a signal that all available passengers are loaded, even if the vehicle 16 has empty seats. In certain embodiments, the occupancy status may be a first status associated with a vehicle permitted to enter the attraction path or a second status associated with a vehicle designated to re-loop onto the loading path 56. Providing the load confirmation signal may include pressing a button on a control panel, utilizing a key, utilizing a short range communication device (e.g., an RFID tag), or any other suitable input. Alternatively or additionally, the load confirmation of the ride first vehicle 16 may be automatic and based on sensor detection of the passengers within the first ride vehicle 16. The controller (e.g., an attraction controller and/or a respective controller of the first ride vehicle 16) may receive the load confirmation signal and, based on the load confirmation signal, adjust the second track switch 26 to the third position to cause the first ride vehicle 16 to travel in the third direction 62 to the attraction path 18. That is, generally, at block 92, if the passenger(s) have successfully loaded into the first ride vehicle 16 and the controller has received the load confirmation signal, the first ride vehicle 16 may be directed via the second track switch 26 toward the attraction path 18 (block 94). The first ride vehicle 16 may then travel along the attraction path 18 and eventually arrive back at the loading zone 10 (block 82).

However, at block 90, if the controller and/or operator determines that the passenger(s) have not successfully loaded into the first ride vehicle 16, at block 96, the first ride vehicle 16 may be directed along the loading path 56 from the second track switch 26 toward the first track switch 24 (e.g., along the secondary portion 66 of the loading path 56). For example, in some embodiments, the loading system 12 may direct the first ride vehicle 16 along the secondary portion 66 of the loading path 56 by default, such as if no input is received from the operator confirming load of the first ride vehicle 16. More specifically, the second track switch 26 may be in the fourth position to direct the first ride vehicle 16 in the fourth direction 64 by default. If no load confirmation signal is received by the controller, the second track switch 26 may remain in the fourth position. After traveling along the secondary portion 66 of the loading path 56, the first ride vehicle 16 may once again be directed along the main portion 65 of the loading path 56 (block 84). A controller may operate to manage merging of the ride vehicles 16 to re-loop onto the main portion 65 of the loading path 56 into available spaces (block 98).

The ride vehicles 16 moving along the main portion 65 of the loading path 56 may generally move along the loading path 56 at constant intervals. As such, assuming that each ride vehicle 16 is also directed along the attraction path 18 from the second track switch 26, the ride vehicles 16 may also generally travel along the attraction path 18 at constant intervals. However, as described in the embodiments of block 96, the first ride vehicle 16 may be directed from the second track switch 26 along the secondary portion 66 if passengers have not successfully loaded into the first ride vehicle 16, as opposed to being directed along the attraction path 18. Once the ride vehicle 16 traveling along the secondary portion 66 of the loading path 56 reaches the first track switch 24, the first track switch 24 may be placed in the second position to direct the ride vehicle 16 along the second direction 60 to continue along the main portion 65 of the loading path 56. That is, upon reaching the first track switch 24 from the secondary portion 66, the ride vehicle 16 may once again be directed along the loading path 56, as described in the embodiments of block 84.

In such embodiments, an extended interval (e.g., a gap, a bubble, a space), may occur between two adjacent ride vehicles 16 traveling along the attraction path 18 due to the first ride vehicle 16 having been disposed between the pair of adjacent ride vehicles 16 along the loading path 56, being directed to the first track switch 24 instead of to the attraction path 18. Accordingly, in block 100, when the pair of adjacent ride vehicles 16 traveling along the attraction path 18 with the extended interval arrives to the variable speed zone 28, the extended interval between the pair of adjacent ride vehicles 16 may be normalized. That is, the interval between the adjacent ride vehicles 16 may become substantially uniform with the intervals between other ride vehicles 16 traveling through the variable speed zone 28. This may be accomplished by increasing or decreasing a speed of one or more ride vehicles 16 traveling through the variable speed zone 28. The adjustment in spacing may also be coordinated with re-looping of upcoming vehicles 16 from the secondary portion 66 of the loading path 56 into the main portion 65 of the loading path 56.

At block 100, a speed of a second ride vehicle 16 traveling through the variable speed zone 28 may be adjusted to create a space for the first ride vehicle 16 traveling along the secondary portion 66 toward the first track switch 24. Generally, the ride vehicles 16 may arrive to the variable speed zone 28 from the attraction path 18 before moving to the loading path 56. While in the variable speed zone 28, the ride vehicles 16 may travel at a nominal speed to transition to the loading path 56 at regular intervals. However, once the first ride vehicle 16 is directed from the second track switch 26 along the secondary portion 66 of the loading path 56 (e.g., due to no confirmation signal being received), a speed of one or more vehicles 16 (e.g., the second ride vehicle) within the variable speed zone 28 may be adjusted to approximately double an interval between a pair of adjacent ride vehicles 16. In this manner, the first ride vehicle 16 traveling from the second track switch 26 may be positioned between the pair of adjacent ride vehicles 16 of the variable speed zone 28 as the pair of adjacent ride vehicles 16 transitions to the loading path 56. Indeed, the act of the first ride vehicle 16 being directed along the secondary portion 66 from the second track switch 24 may feed into the controller managing the merging in block 98.

Figure 4:
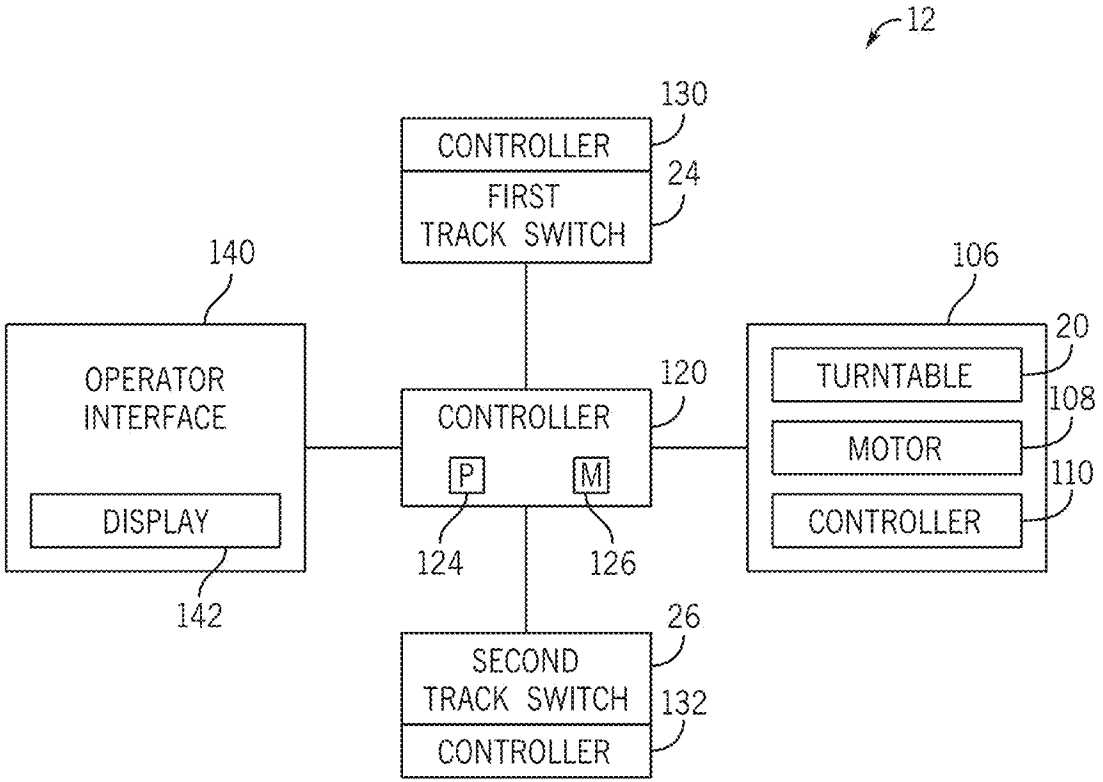
FIG. 4 is a block diagram of an embodiment of the loading system.

FIG. 4 is a block diagram of the loading system 12. As seen in FIG. 4, the loading system includes a turntable assembly 106 that drives rotation of the turntable 20 via a motor 108 and a turntable controller 110. The turntable controller 110 may be coupled to a central ride controller 120, and may communicate through a wireless network (e.g., wireless local area networks [WLAN], wireless wide area networks [WWAN], near field communication [NFC]) and/or through a wired network (e.g., local area networks [LAN], wide area networks [WAN]). The controller 120 includes a processor 124 and a memory 126. It should be understood that other disclosed components of the loading system 12 may also include a memory and processor and may operate to execute processor-based instructions stored in a memory.

The central ride controller 120 may also control vehicle movement, variable vehicle movement (e.g., through the variable speed zone 28), merging from the secondary portion 66 of the loading path 56 during re-looping, and may communicate with the first track switch 24 and the second track switch 26 and their respective controllers 130, 132 to direct movement of the ride vehicles 16 between the attraction path 18 and the loading path 56. For example, in one embodiment, the controller 120 may receive a signal, or data, that one or more ride vehicles 16 approaching the second track switch 26 have an occupancy status associated with being moved onto the attraction path 18. As the ride vehicle or ride vehicles 16 approach the second track switch 26, the second track switch 26 receives a signal to switch to (or remain in) an attraction path position. In another example, when the ride system 14 is in operation and the ride vehicles 16 traversing the loading path 56 remain unloaded, the second track switch 26 receives a signal from the controller 120 to move to (or remain in) a position to re-loop the ride vehicle 16. The controller 120 may keep track of all vehicles 16 of the ride system 14 and their respective locations either on the loading path 56 or on the attraction path 18. Further, the controller 120 may control re-looping of empty vehicles 16 or entry into a maintenance or holding path to maintain a desired or fixed number of vehicles 16 in the attraction path 18. That is, the controller 120 may log entry of vehicles 18 onto the attraction path 18 and may prevent too many vehicles 16 from being on the attraction path 18 by directing vehicles 16 to re-loop until space is available.

The central controller 120 may permit operator input via an operator interface 140, which may include a display 142. In some embodiments, an operator may send one or more signals to the central controller 120 via the operator interface 140 to operate the loading system 12 as discussed herein.

Overall, the embodiments disclosed herein include systems and methods configured to provide variable loading time for passengers loading into ride vehicles. For example, the disclosed embodiments include an attraction with a loading zone having ride vehicles configured to rotate in conjunction with a turntable while passengers unload and load the ride vehicles. Generally, passengers have a set amount of time to load into the ride vehicles as the ride vehicles travel through the loading zone. However, if a passenger uses more than the set amount of time to load into a ride vehicle, the passenger and the ride vehicle may be re-looped to a start of the loading zone. Specifically, the re-looping of the ride vehicle may be implemented without negatively affecting the progress of other ride vehicles through the loading zone or through the attraction. In this manner, passengers are provided with an increased or variable amount of time to load into ride vehicles, without significantly hindering movement of other ride vehicles and allowing the overall ride system 14 to continue normal operation. The uninterrupted progress of the ride vehicles through the attraction enables the attraction to cycle high volumes of guests through the attraction, thereby increasing an efficiency of the attraction.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. An attraction loading system, comprising:
a loading station;
a loading path disposed around the loading station;
an attraction path coupled to the loading path; and
a ride vehicle configured to enter the attraction path from the loading path via a second track switch, wherein the ride vehicle is configured to enter the loading path via a first track switch, wherein the system is configured to control entry of the ride vehicle to the attraction path from the loading path at least partially based on an occupancy status of the ride vehicle.

2. The attraction loading system of claim 1, wherein the loading path comprises one or more tracks.

3. The attraction loading system of claim 1, wherein the loading path is trackless.

4. The attraction loading system of claim 1, comprising:
another ride vehicle; and
a ride controller configured to adjust a speed of the ride vehicle and a speed of the other ride vehicle, where the speed of the ride vehicle is different from the speed of the other ride vehicle.

5. The attraction loading system of claim 4, wherein the ride controller is configured to control the speed of the ride vehicle to adjust a spacing of the ride vehicle relative to the other ride vehicle.

6. The attraction loading system of claim 1, wherein the loading path has a circular shape.

7. The attraction loading system of claim 1, wherein the loading path has an irregular shape.

8. The attraction loading system of claim 1, comprising a stationary entrance path coupled to the loading station.

9. An attraction loading system, comprising:
a loading area;
a loading path disposed about the loading area;
an attraction path coupled to the loading path; and
a ride vehicle configured to enter the attraction path or re-loop the loading path based at least on an occupancy status of the ride vehicle.

10. The attraction loading system of claim 9, wherein the occupancy status indicates that the ride vehicle is fully loaded, partially loaded, or empty.

11. The attraction loading system of claim 9, wherein the occupancy status is indicated by an operator input signal.

12. The attraction loading system of claim 9, wherein the occupancy status is indicated by a sensor signal.

13. The attraction loading system of claim 9, wherein the loading area comprises a conveyor.

14. The attraction loading system of claim 9, wherein the loading path has a circular shape.

15. The attraction loading system of claim 9, wherein the loading path has an irregular shape.

16. An attraction loading method, comprising:

directing a first ride vehicle along a loading path, wherein the loading path comprises a path about a loading station;

directing a second ride vehicle along the loading path; and controlling a direction of the first ride vehicle from the loading path onto an attraction path at least partially based on an occupancy status of the first ride vehicle indicating that the first ride vehicle is fully loaded, wherein the attraction path is coupled to the loading path.

17. The method of claim 16, comprising controlling a direction of the second ride vehicle to re-loop the loading path based on an occupancy status of the second ride vehicle indicating that the second ride vehicle is partially loaded or empty.

18. The method of claim 16, comprising adjusting a space between the first ride vehicle and the second ride vehicle.

19. The method of claim 18, wherein adjusting the space between the first ride vehicle and the second ride vehicle comprises controlling a speed of the first ride vehicle and a speed of the second ride vehicle, wherein the speed of the first ride vehicle is different from the speed of the second ride vehicle.

20. The method of claim 16, wherein the occupancy status is determined based on a sensor signal.

21. The method of claim 16, wherein the occupancy status is determined based on an operator input signal.

22. The method of claim 16, wherein the loading path comprises one or more tracks.

* * * * *